United States Patent [19]

Mizuta

[11] 4,439,931

[45] Apr. 3, 1984

[54] CONTROL MEANS FOR A DRIER

[75] Inventor: Masaji Mizuta, Uji, Japan

[73] Assignee: Dainippon Screen Seizo Kabushiki Kaisha, Kyoto, Japan

[21] Appl. No.: 357,625

[22] Filed: Mar. 12, 1982

[30] Foreign Application Priority Data

May 7, 1981 [JP] Japan ..... 56-65056[U]

[51] Int. Cl.[3] ..... F26B 21/10; F26B 21/12

[52] U.S. Cl. ..... 34/44; 34/48; 34/54; 219/364; 219/486; 219/506

[58] Field of Search ..... 219/486, 501, 508, 364; 34/46, 48, 56, 52, 54, 44, 45

[56] References Cited

U.S. PATENT DOCUMENTS 3,372,488 3/1968 Koch et al. ..... 34/48

3,878,619 4/1975 Hodgett et al. ..... 34/49

*Primary Examiner*—Larry I. Schwartz

*Attorney, Agent, or Firm*—Poms, Smith, Lande & Rose

[57] ABSTRACT

Control means for a drier for films or sheets using a minimum of electric power. A heater is connected to a semiconductor switch and an alternating-current power supply in series. An oscillator outputs a pulse to a turn-on terminal of the semiconductor switch via an OR gate in synchronization with a certain phase angle of the wave form of the alternating voltage turning on the semiconductor switch for approximately 10% of the rated value of the heater thereby preheating the heater. When an entrance sensor detects the presence of films or sheets entering the drier, a starting signal is sent to a flip-flop circuit which outputs a high level signal to the turn-on terminal of the semiconductor switch via the OR gate activating the heater to full rated value. The high level signal is also sent to the turn-on terminal of a second semiconductor switch activating a second heater and a blower. When an exit sensor detects the presence of films or sheets leaving the drier, the exit sensor sends a stopping signal to the flip-flop circuit which outputs a low level signal turning off the second heater and blower and returning the first heater to the preheat phase.

3 Claims, 1 Drawing Figure

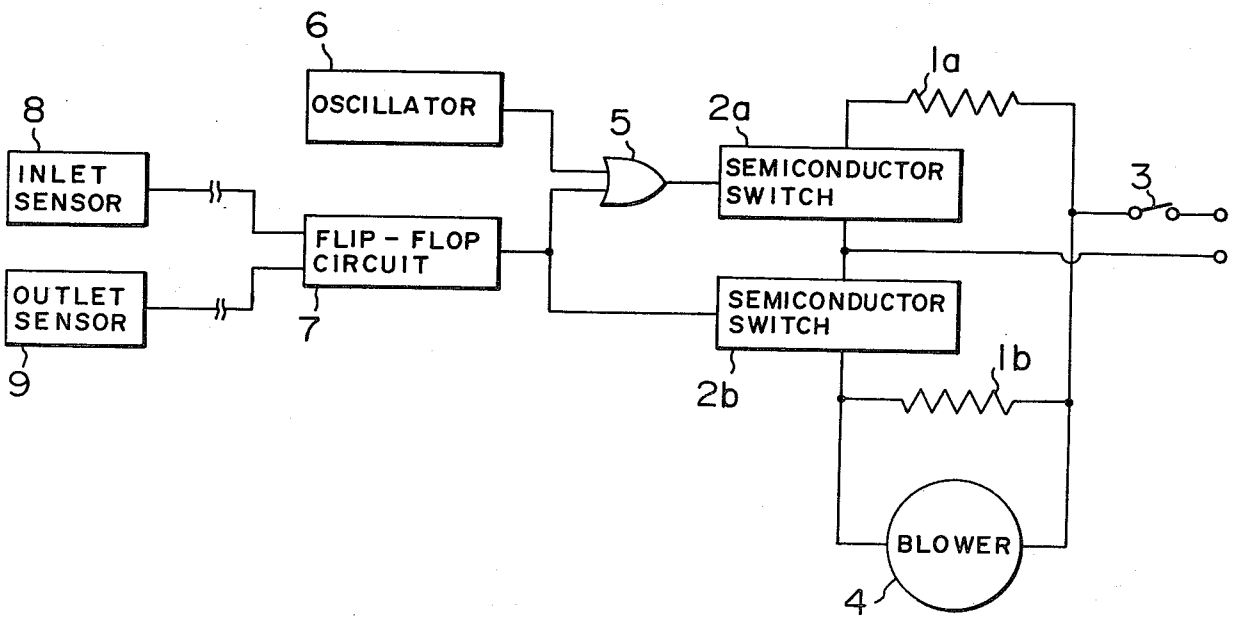
3
1a
1b
SEMICONDUCTOR SWITCH
SEMICONDUCTOR SWITCH
BLOWER
2a
2b
4
5
OSCILLATOR
FLIP - FLOP CIRCUIT
6
7
INLET SENSOR
OUTLET SENSOR
8
9

CONTROL MEANS FOR A DRIER

BACKGROUND OF THE INVENTION

This invention relates to control means for a drier or for use in a developer, printer, or the like having a drier.

In a conventional drier, automatic film developer, or printer, a photosensitive film which is developed and washed by water is dried in a short time by warm air in a drying tank.

In such a conventional automatic developer, the primary use of electricity is the drier. In order to save power, the supply of electric power to the drier should be stopped when no film is fed to the developer. Electric power should be automatically supplied to the drier when film is inserted in the developer. By the time the film reaches the drying tank after passing through the developing tank and the washing tank, the warm air necessary for drying is available in the drying tank.

However, since the drier has a large heat capacity, a relatively long time is needed to raise the temperature of the air to the proper degree. The first photosensitive film in a series to enter the drier often cannot be dried completely when the drier starts heating from room temperature.

On the other hand, when a heater is used that is sufficiently large to dry the first film completely, excessive electric power is consumed for drying the following films, which is uneconomical.

In order to solve this problem, the drier is preheated and the blower that moves the air during drying is stopped to prevent the drier from cooling completely when no film is being fed or the developing operation is stopped. This can be performed in several ways. For example, the heater may be operated at a low voltage, or the rated electric power may be intermittently supplied to the heater. However, in the former embodiment, a large-sized transformer is required, which means high cost. In the latter embodiment, the nichrome wires of the heater are overheated because the blower is stopped during the stop of the developing operation, resulting in deformation of the nichrome wires.

SUMMARY OF THE INVENTION

It is an object of the present invention to provide control means for a drier which is simple in construction and is capable of drying photosensitive films completely by using only the necessary minimum electric power.

According to the present invention there is provided control means for a drier, comprising (a) a heater for drying, (b) a semiconductor switch connected to the heater in series, (c) an OR gate having an output terminal connected to a turn-on terminal of the semiconductor switch, (d) an oscillator connected to one input terminal of the OR gate which outputs a pulse turning on the semiconductor switch in synchronization with a certain phase angle of a wave form of the alternating voltage generated by an alternating-current power supply for heating the heater, (e) a flip-flop circuit having an output terminal connected to the other input terminal of the OR gate, (f) a pair of sensors which are connected to the input terminals of the flip-flop circuit and detect the entrance and exit of an object into or out of the drier, and (g) a blower which is controlled by the entrance and exit signals generated by the sensors which operates during the drying of the object.

BRIEF DESCRIPTION OF DRAWING

In order that the present invention may be better understood, a preferred embodiment thereof will be described with reference to the accompanying drawing, in which:

The FIGURE is a block diagram of a control means for a drier according to the present invention.

DESCRIPTION OF THE PREFERRED EMBODIMENT

Referring now to the drawing there is shown in the FIGURE a control means for a drier according to the present invention.

A pair of electric heaters 1*a* and 1*b* are arranged in parallel. A pair of semiconductor switches 2*a* and 2*b* such as thyristors, or the like, are connected to the electric heaters 1*a* and 1*b*, in series, respectively. An alternating voltage generated by an alternating-current power supply (not shown) is supplied to the pair of electric heaters 1*a* and 1*b* and semiconductor switches 2*a* and 2*b* connected thereto, in common, via a power switch 3. A blower 4 is connected to the electric heater 1*b* in parallel therewith.

The turn-on terminal of the semiconductor switch 2*a* is connected to an output terminal of an OR gate 5. One input terminal of the OR gate 5 is connected to an oscillator 6. The oscillator 6 outputs a pulse for turning on the semiconductor switch 2*a* in synchronization with a certain phase angle of a wave form of the alternating voltage generated by the alternating-current power supply. In this embodiment, the turn-on phase angle for the semiconductor switch 2*a* is determined so that approximately 10% of the rated electric power of the alternating voltage is supplied to the electric heater 1*a*.

The other input terminal of the OR gate 5 and the turn-on terminal of the semiconductor switch 2*b* are connected to an output terminal of a flip-flop circuit 7. One input terminal of the flip-flop circuit 7 is connected to an entrance sensor 8 and the other input terminal is connected to an exit sensor 9 which are properly disposed respectively at the entrance and exit of the drier.

When the power switch 3 is turned on, the pulse generated by the oscillator 6 is input to the semiconductor switch 2*a* through the OR gate 5 thereby closing the semiconductor switch 2*a*. Accordingly, about 10% of the rated electric power is fed to the heater 1*a* to preheat the drier. During the preheat phase when a film is not in the drier, the level of the input signal from the flip-flop circuit 7 is low and the semiconductor switch 2*b* remains open. Hence, the heater 1*b* and the blower 4 are not in operation.

When film is fed into the drier, the entrance sensor 8 detects the entrance of the film and outputs a starting signal to the flip-flop circuit 7. The flip-flop circuit 7 is turned over and outputs a high level signal to the semiconductor switches 2*a* and 2*b*, the former via the OR gate 5, with the result that the two semiconductor switches 2*a* and 2*b* close. The heater 1*a* is then heated by the full rated electric power of the alternating voltage, the other heater 1*b* is heated, and the blower 4 is placed in operation.

The photosensitive film fed into the drier is dried in the predetermined time completely by the proper warm or hot air.

When the dried film leaves the drier, the exit sensor 9 detects the discharge of the film and outputs a stopping signal to the flip-flop circuit 7. The flip-flop circuit 7 is turned over by the stopping signal and outputs a low level signal. Accordingly, the heater 1*b* and the blower 4 are deactivated and the heater 1*a* returns to the preheat phase where it is activated by the output pulse generated by the oscillator 6, as described above, in order to prevent the drier from cooling.

Although the present invention has been described in some detail by way of illustration and example for purposes of clarity of understanding, it will, of course, be understood that various changes and modifications thereof may be made in the form, details, and arrangements of the parts without departing from the scope of the present invention.

For example, the number of the heaters is not restricted to those illustrated. Any number of heaters can be used.

What is claimed is :

1. A control means for an electric drier receiving power from an alternating-current power supply and having an electric heater for heating air and an electric blower for moving the heated air over an object to be dried, comprising in combination:

(a) a semiconductor switch connected in series between the alternating-current power supply and the heater;

(b) an OR gate having two input terminals and one output terminal, the output terminal connected to the turn-on terminal of the semiconductor switch;

(c) an oscillator connected to one of the two input terminals of the OR gate which outputs a pulse for turning on the semiconductor switch in synchronization with a certain phase angle of the wave form of the alternating current from the power supply to operate the heater in a preheat mode at a percentage of the rated value;

(d) a flip-flop circuit having two input terminals and an output terminal connected to the other of the two input terminals of the OR gate;

(e) an entrance sensor connected to one of the input terminals of the flip-flop circuit and the blower for sensing the presence of the object entering the dryer, and (f) an exit sensor connected to the other of the two input terminals of the flip-flop circuit and the blower for sensing the presence of the object leaving the dryer;

whereby, when the entrance sensor detects the entrance of an object into the drier and outputs a starting signal to the blower and the flip-flop circuit, the blower starts, the flip-flop circuit turns over and outputs a high level signal to the OR gate, the OR gate passes the high-level signal to the semiconductor switch, the semiconductor switch turns on the full rated power of the alternating voltage, and the second semiconductor switch turns on the blower; and, when the exit sensor detects the exit of an object out of the drier and outputs a stopping signal to the blower and the flip-flop circuit, the blower stops, the flip-flop circuit turns over and outputs a low level signal to the OR gate, the OR gate allows the pulse from the oscillator to pass to the semiconductor switch returning the heater to the preheat mode.

2. A control means as defined in claim 1, and further comprising another heater and another semiconductor switch connected thereto in series having a turn-on terminal connected to the output terminal of the flip-flop circuit whereby the high-level signal from the flip-flop circuit turns on the another semiconductor switch and the another heater, and the low-level signal from the flip-flop circuit turns off the another semiconductor switch and the another heater.

3. A control means as defined in claim 2 wherein the another semiconductor switch also controls the operation of the blower.

* * * * *